United States Patent [19]

TheiBen et al.

[11] Patent Number: 4,704,068

[45] Date of Patent: Nov. 3, 1987

[54] PROCESS FOR INTRODUCING AN ADSORPTION AGENT

[75] Inventors: Friedel TheiBen, Erkelenz; Martin Kesten, Rosrath-Hoffnungsthal, both of Fed. Rep. of Germany

[73] Assignee: Messer Griesheim GmbH, Fed. Rep. of Germany

[21] Appl. No.: 834,315

[22] Filed: Feb. 27, 1986

[30] Foreign Application Priority Data

Mar. 7, 1985 [DE] Fed. Rep. of Germany ..... 3508059
Jan. 8, 1986 [DE] Fed. Rep. of Germany ..... 3600298

[51] Int. Cl.[4] ..... F04B 37/02
[52] U.S. Cl. ..... 417/48; 220/420
[58] Field of Search ..... 141/8, 59, 60, 61, 65; 220/420, 421, 422, 423, 424, 425, DIG. 9; 417/48, 49, 51

[56] References Cited

U.S. PATENT DOCUMENTS

| | | | |
|---|---|---|---|
| 1,561,101 | 11/1925 | Mott et al. | 220/420 |
| 2,100,746 | 11/1937 | Miller, et al. | 417/48 X |
| 3,114,469 | 12/1963 | Francis et al. | 220/422 |
| 4,272,259 | 6/1981 | Patterson et al. | 417/48 X |

*Primary Examiner*—Stephen Marcus
*Assistant Examiner*—Mark Thronson
*Attorney, Agent, or Firm*—Harold Pezzner

[57] ABSTRACT

An adsorption agent is introduced in the insulation chamber of a vacuum insulated double walled vessel for the storage of low-boiling liquefied gases. Specifically the adsorption agent is installed in the chamber before producing the vacuum by housing the agent within a gas and water tight container which bursts in a vacuum.

9 Claims, 2 Drawing Figures

PROCESS FOR INTRODUCING AN ADSORPTION AGENT

BACKGROUND OF THE INVENTION

Vessels for storing ultra-cold liquefied gases must always be equipped with expensive insulation in order to keep low the level of vaporization of the liquefied gas due to heat coming in from the environment. They are consistently designed as double walled vessels whereby an insulation chamber is formed between the inner wall and the outer wall. This insulating effect is produced due to the fact that the gap between the walls is filled with a material which conducts heat poorly, for example "Superinsulation" and evacuated after the vessel is completely prepared.

Insulating vacuums of about $10^{-3}$ mbar are needed in order to reduce the heat conductivity of the gas to a minimum. Such pressures can be quickly produced by means of suitable pumping stations. Because of microleakage and desorption, the pressure would in time rise, however, after sealing the insulation chamber which would result in an increase in the rate of vaporization of the liquefied gas and a worsening of the vessel's quality. In order to prevent this from happening, adsorption materials, for example activated charcoal or molecular sieve, are installed in the chamber, namely, directly onto the inner vessel. The adsorption materials have the property of being able to adsorb a large amount of gas molecules at low temperatures, even in a vacuum, and thus insure that, under operating conditions,—in other words, with a cold inner vessel—the pressure in the insulation chamber is adequately low even after several years of the life of the vessel.

In the production of cryo-vessels, a problem is encountered, however, due to the high affinity of the adsorption agent, especially molecular sieve, for moisture. They are able to take up several percent (by weight) of water, whereby their adsorption capacity for other materials is significantly reduced. For this reason, they are activated before installation in the vessel which essentially means that they are freed from their adsorbed water. This is done by heating to 100° C. (activated charcoal) or 300° C. (molecular sieve) and simultaneously evacuating.

During the manufacture of the vessel, the adsorption agents are again exposed to atmospheric air so that they can again adsorb water. In addition to this, the other materials introduced into the insulation chamber are loaded with water molecules which must be removed after the construction of the vessel by heating and flushing with dry nitrogen. As a result of this, considerable partial pressures caused by water vapor can occur which likewise contribute to loading the adsorption agent with moisture again. The prior activation of the adsorption agent is, as a result, practically nullified. As a consequence of this, the heating and evacuation periods before sealing the insulation chamber are essentially lengthened thus causing an increased time expenditure as well as enormous additional energy costs.

SUMMARY OF THE INVENTION

The object of the invention is to achieve a process for introducing an adsorption agent into the insulation chamber of vacuum insulated double walled vessels used for storing low boiling liquefied gases, according to which process the reloading of the activated adsorption agent with moisture before the production of the vacuum is avoided and thus the heating and evacuation times are reduced.

According to the process of the invention, the activity of the adsorption agent is maintained because the adsorption agent is packed, after activation, in gas-and-moisture-tight containers, for example, sealed edge pouches of metallized plastic films. The packs are attached, at the beginning of the vessel's manufacture, onto the inner vessel and keep the adsorption agent sealed in. It is only during the final evacuation, as a result of the below normal pressure, that an overpressure occurs inside the packs which, in turn leads to the destruction of the packs and thus to the release of the adsorption agent.

It is advantageous to pack the adsorption agent at an increased temperature. The adsorption agent is, hereby, not loaded as much with gas during packing as at room temperature. As a result of this, the packing container does not already burst during evacuation but only then, when the insulation chamber is baked out at the temperature which is at least nearly that of the temperature at which the adsorption agent was packed. Therefore, one can, in this case, evacuate this vessel at low temperature, for example to test for leakage without releasing the adsorption agent. Likewise, the insulation chamber can be baked out without producing a vacuum.

The packing temperature should amount to at least 50° C. in order to achieve the described effects. The maximum temperature is limited only by the thermal stability of the packing container and can amount to several hundred °C. Since, as a rule, one bakes out at about 100° C., there is an upper packing temperature limit of 120° C. for the majority of practical applications.

The attachment of the packs filled with adsorption agent onto the inner vessel is purposeful because the lowest temperatures occur there. Basically, the packs can also be attached at other locations.

The invention is, of course, not restricted to the use of sealed edge pouches or packs. Any container which satisfies the criteria of water-and-gas impermeability as well as bursting in vacuum is suitable. Thus, for example, one can use rigid containers with a single opening if this opening is sealed with an appropriate film or foil. Such a container can be mounted, in the form of a circular ring, about the neck tube of the cryovessel.

THE DRAWINGS

FIG. 1 illustrates in cross section a sealed edge pouch with an adsorption agent in accordance with this invention; and FIG. 2 illustrates in cross section a container with adsorption agent mounted about the neck ring in accordance with this invention.

DETAILED DESCRIPTION

Figure 1:
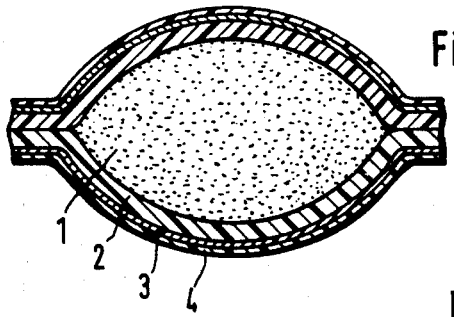

The container illustrated in FIG. 1 is a sealed edge pouch filled with molecular sieve 1. The material of the sealed edge pouch is an adhesive-laminated compound film of plastic and metal. Specifically, it consists of a 75μ thick polypropylene film 2, a 12μ u thick aluminum foil 3 and a likewise 12μ thick biaxially stretched out polyester film 4. The outer dimensions of the sealed edge pouch are 10 cm×20 cm.

Figure 2:
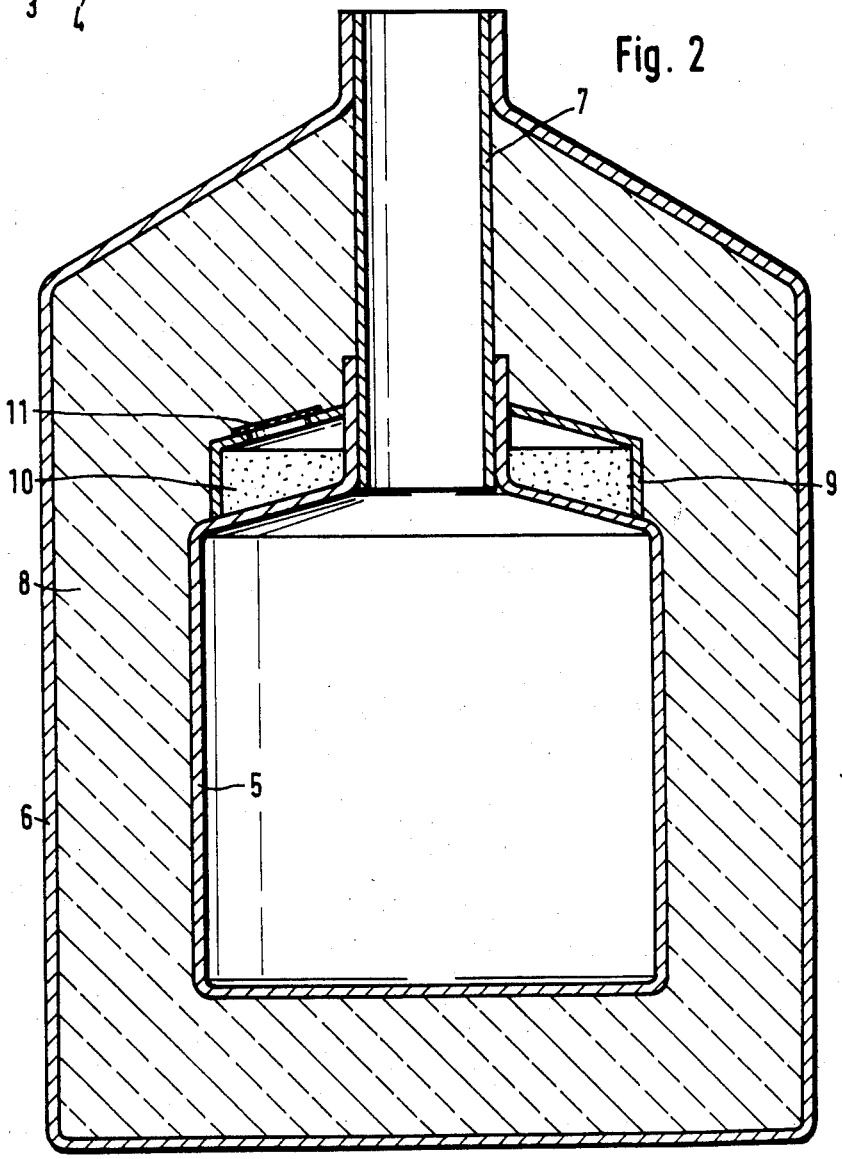

FIG. 2 shows a cryovessel consisting of an inner vessel 5 and an outer vessel 6, connected by a neck tube 7. Between the inner vessel 5 and the outer vessel 6, there is a superinsulator 8. According to the invention, an annular adsorption agent container 9 with adsorption agent 10 is mounted about the neck tube 7. The adsorption agent container is, according to the invention, sealed with an aluminum foil 11 which bursts at low pressure.

SUMMARY

In the manufacture of cryovessels, adsorption materials, especially molecular sieve and activated charcoal, are introduced in order to maintain good insulating vacuums over long periods of time. These adsorption agents are exerted upon to take up moisture as a result of which their takeup capacity for other gases is significantly reduced. Previously activated adsorption materials, especially molecular sieve, takes up water again during the manufacture of the vessel, which it releases only with great difficulty. The vessels must therefore be baked out for a long time and evacuated before sealing the insulation chamber. In order to reduce this long heating time, the adsorption agent is packed in gas and-water tight containers, for example, sealed edge pouches of metallized plastic and then installed in the insulation chamber. The packing occurs preferably at temperatures of about 100° C. In this manner, the takeup of water during the manufacture of the vessel is prevented. The pack is destroyed during the final evacuation of the insulating chamber as a result of its inner overpressure and the adsorption material is released.

What is claimed is:

1. In a process for introducing an adsorption agent in the insulation chamber of vacuum insulated double walled vessels for the storage of low boiling liquefied gases, the improvement being in installing the adsorption agent in the insulation chamber at a location subjected to a vacuum before producing the vacuum by housing the adsorption agent within a gas-and-water tight container , and bursting the container in response to the vacuum.

2. Process according to claim 1, characterized therein in further comprising the step of placing the adsorption agent in the container at a temperature above room temperature.

3. Process according to claim 2, characterized therein that the adsorption agent is filled in at temperatures between 50° and 100° C.

4. Process according to claim 3, characterized therein that the adsorption agent is filled in at a temperature of 100° C.

5. Process according to claim 1, characterized therein in the step of placing the container at a location which is inaccessible from the exterior of the vessel.

6. In an arrangement for introducing an adsorption agent in the insulation chamber of a vacuum insulated double walled vessel for the storage of low boiling liquefied gases, the improvement being a container, the adsorption agent being housed in said container, and said container being a sealed edge pouch of metallized plastic capable of bursting in a vacuum.

7. Container according to claim 6, characterized therein that said plastic is a film consisting of a polypropylene film onto which an aluminum foil and a biaxially stretched out polyester film have been adhesively laminated.

8. Container according to claim 6, characterized therein that said container is disposed at a location within said chamber which is inaccessible from the exterior of said vessel.

9. Container according to claim 8, characterized therein that said vessel comprises an inner vessel wall and an outer vessel wall with said insulation chamber being therebetween and with said inner wall having a neck tube extending through said outer wall, and said container being around said neck tube.

* * * * *